US008931158B2

(12) United States Patent
Morrison et al.

(10) Patent No.: US 8,931,158 B2
(45) Date of Patent: Jan. 13, 2015

(54) LIQUID VESSEL LINER AND METHOD OF APPLICATION

(75) Inventors: Frank T. Morrison, Crownsville, MD (US); Greg M. Lowman, Pasadena, MD (US); John R. Hawkins, Riva, MD (US); James W. Furlong, Baltimore, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 994 days.

(21) Appl. No.: 12/931,107

(22) Filed: Jan. 25, 2011

(65) Prior Publication Data

US 2011/0117285 A1 May 19, 2011

Related U.S. Application Data

(62) Division of application No. 11/454,648, filed on Jun. 16, 2006, now abandoned.

(51) Int. Cl.

| | |
|---|---|
| ***B65D 6/00*** | (2006.01) |
| ***B05D 1/06*** | (2006.01) |
| ***B05D 7/14*** | (2006.01) |
| ***B05D 7/00*** | (2006.01) |
| ***F24H 1/18*** | (2006.01) |
| *B05D 7/22* | (2006.01) |
| *F28F 25/00* | (2006.01) |

(52) U.S. Cl.

CPC .. *B05D 1/06* (2013.01); *B05D 7/14* (2013.01); *B05D 7/54* (2013.01); *F24H 1/183* (2013.01); *B05D 7/22* (2013.01); *F28F 2025/005* (2013.01)

USPC ..... 29/458; 29/527.1; 220/4.12; 220/62.22

(58) Field of Classification Search

USPC ..... 29/455.1, 458, 462, 525.01, 525.02, 29/525.11, 527.1, 527.2, 530, 801; 220/4.01, 4.12, 4.13, 4.14, 4.16, 4.17, 220/4.33, 62.11, 62.22, 692, 693, 677, 610, 220/622, 626

See application file for complete search history.

(56) References Cited

U.S. PATENT DOCUMENTS

| | | | | | |
|---|---|---|---|---|---|
| 567,667 | A | * | 9/1896 | Tallerday | 220/693 |
| 1,381,877 | A | * | 6/1921 | Ickes | 220/562 |
| 1,801,468 | A | * | 4/1931 | Van Dusen | 220/692 |
| 2,592,419 | A | * | 4/1952 | Harper et al. | 220/4.17 |
| 3,606,958 | A | * | 9/1971 | Coffman | 220/62.22 |

(Continued)

*Primary Examiner* — Christopher M Koehler
(74) *Attorney, Agent, or Firm* — Edward J. Brosius

(57) ABSTRACT

A liner and method of application for use on a metal surface to protect metal structures such as cooling towers, evaporative condensers, and other liquid containing vessels such as tanks from corrosion, leaks, and wear. The liner is an inexpensive apparatus and process comprising a coated metal having a second sealing and bonding layer and a third protective sealing layer. The liner method comprises applying an organic bonding layer onto the galvanized substrate, and applying an elastomeric barrier coating to the bonding layer. The barrier coating material is applied to preseal the seams between adjoining panels assembled to form the basin. The barrier coating is applied to the entire inside of the basin to form a homogenous barrier coating extending out of the basin. The liner edge is isolated from the basin by extending the liner to a point between the basin and an upper section. The liner comprises galvanizing layer, a bonding layer on the galvanized metal, and an elastomeric third layer on the bonding layer. The liner further comprises preseals at the seams, corner molds and link holes in the substrate to attach and protect the liners integrity.

1 Claim, 5 Drawing Sheets

(56) References Cited

U.S. PATENT DOCUMENTS

| | | | | |
|---|---|---|---|---|
| 4,036,390 | A * | 7/1977 | Morse | 220/562 |
| 4,540,637 | A * | 9/1985 | Geary et al. | 428/626 |
| 4,620,815 | A * | 11/1986 | Goetter | 411/84 |
| 5,381,915 | A * | 1/1995 | Yardley | 220/4.33 |
| 6,715,243 | B1 * | 4/2004 | Fons | 52/192 |
| 8,397,366 | B2 * | 3/2013 | Gotz et al. | 29/428 |
| 2007/0000923 | A1 * | 1/2007 | Chen et al. | 220/4.33 |

* cited by examiner

LIQUID VESSEL LINER AND METHOD OF APPLICATION

This application is a division of U.S. application Ser. No. 11/454,648, filed Jun. 16, 2006 now abandoned.

BACKGROUND OF THE INVENTIONS

The present invention relates to liners bonded to liquid containing metal structures and the method of applying and bonding the liner.

DESCRIPTION OF THE RELATED ART

Liquid holding structures such as cooling towers, evaporative condensers, and other evaporative systems for cooling or condensing and holding evaporative liquid are subjected to great mechanical stresses and exposure to corrosive environments. Chemicals used in the water to control water chemistries and to prevent biological growth can also work against the metal structure sections to promote corrosion unless carefully monitored. Such structures are usually made of treated steel, stainless steel, or plastic to protect the basin from corrosion. Plastic or polymer structures may be made from FRP or Polypropylene or similar materials. Fasteners are used to attach the panels together. The seams between the panels are usually sealed separately to give added protection to these areas. These metal structures are more likely to leak at or around the seams. Seams are sealed with a butyl rubber tape and/or a caulk. Prior art systems involved the use of galvanized, plastic or stainless materials to hold the liquid and prevent corrosion. Galvanized basins and structures provide limited resistance to corrosion. Prolonged exposure, especially to treated water having high chlorides and the like, can break down the galvanized coating. The loss of the galvanized coating exposes the panels to the corrosive liquid resulting in a need to repair or replace the structure or sections. Stainless tanks and basins are expensive and may be susceptible to corrosion from certain water chemistries such as high chlorides. Vessels formed from galvanized panels use many more fasteners than are needed to structurally assemble the panels. The fasteners are positioned and inserted to seal the seams as well as hold the panels together. The fasteners may need a fastener hole formed in the aligned flanges. Stainless steel panels can be fastened together with to form the basin or vessel having good corrosion protection to some chemicals. Furthermore, most metal vessels also have square corners and joints making vessel cleaning difficult and drainage an issue as water can pool in a corner or at an angle joint.

Single or multi piece plastic or polymer basins are susceptible to cracking, and may not be structurally sound when containing large volumes. The plastic structures may be flammable, expensive, and damaged by heat or thermal shifts due to climates that have wide temperature range swings. Coatings such as epoxy and polymer coatings on metal have weaknesses especially when the coating is below the water line and exposed to chemicals and the water continuously. Such exposure can results in blistering, cracking, and peeling of the coating and thus exposing the metal substrate to the water and chemicals. Lining the basins with materials such as polyurethane may be difficult because of long cure times and expensive surface preparation. The lined basins are still susceptible to compatibility with sealer material like tape, caulk, and other sealants used which may react with the barrier coating after installation. Furthermore, the polyurethane liners are known to flow through cracks and seams in their liquid state before curing causing uneven coating especially where the liner is needed most, at the seams. Adhesion of the liner to the substrate can also be a problem especially on the bottom and walls below the water level. Water and chemicals attacking the edge interface between the liner and the substrate can penetrate between the liner and the substrate causing corrosion behind the liner. This corrosive damage can be very hard to repair and may damage the integrity of surrounding areas.

Steel structures have been used extensively in the prior art to build structures for holding liquid such as water and treated water for cooling and evaporative functions. A steel structure provides a cost/strength-valued construction, but must be insulated from the liquid. Those skilled in the art would recognize that the prior art teaches that corrosion protection is accomplished with a polymer coating the structure or an organic powder coating. Each coating requires several steps be satisfied. First, the surface must be thoroughly cleaned of all dirt, oil, oxidation products, and any other foreign matter. Second, sites to which the liner can bond must be available on the surface. Third, the coatings must be specially formulated to impart specific wear, adhesion, sealing, and corrosion resistant properties to the steel when applied in layered sequential coatings. Liner joints or seams below the water line can allow penetration of the liquid through the seam and behind the liner promoting corrosion and eventually causing a leak.

The U.S. Pat. No. 4,540,637 to Geary et al. for a PROCESS FOR THE APPLICATION OF ORGANIC MATERIAL TO GALVANIZED METAL is assigned to the assignee of the present invention and the disclosure is by this reference incorporated in its entirety in the present application. The liner protects the surface of the panels from chemical attack and corrosion caused by the water, treated water or other liquid contained in the vessel.

The '637 patent discloses and claims a process for the application of an organic powder coating to galvanized steel comprising a four step process. The panels are acid cleaned to remove contaminates and thoroughly rinsed and dried to prepare the metal galvanized surface for adhesion of the powder coating. The powder coating uses the galvanized layer as a back up corrosion resistant layer to protect and supplement especially where the panels are physically damaged in use destroying a portion of the powder coating.

The prior art also includes roll-on and spray on liners for application to the interior walls of a vessel. These "after market" liners do not adhere well to the substrate due to contamination and corrosion on the surface of the metal. These "after market" liners are more expensive to apply because of surface preparations and labor required for installation. In addition, these prior art liners use cleaners, primer coatings, and/or mechanical surface preparation such as sanding, sand blasting or the like to clean and prepare the surface. Sealants used to seal the seams are butyl tape and/or caulk and may react chemically with the liner and may create a loose attachment of the liner to the substrate causing a compromised installation.

SUMMARY OF THE INVENTION

The present invention is a factory-installed liner for use in evaporative cooling, condensing and similar systems holding and circulating hot and cold liquids for heat transfer and storage. The liner includes a coated metal such as galvanized steel as a structural substrate having a powdered polymer coating electrostatically applied and baked on the clean galvanized surface. The organic powder polymer bonds chemically and mechanically to the galvanized metal substrate and provides a clean, dry and possibly warm surface for the elastomeric barrier coating to mechanically and chemically adhere to. Additional support is provided for the barrier coating by holes formed in the substrate panels of the structure, forms placed in the corners, liner edges isolated from contact with flowing or standing water and seams attached without caulks and sealants. The holes are formed prior to application of the organic powder. The organic powder is applied to flow through sealing the hole and the surrounding galvanized material on the inside and outside surfaces. The forms provide better drainage to prevent standing water when the vessel is not in use. The forms are for allowing draining along the vessel edges where dirt, debris, and corrosive elements may become trapped and stand degrading the barrier coating. The panels are attached using mechanical fasteners in the standard manner of connecting panels to form a contiguous vessel wall. Fasteners are used in assembling the panels. The caulk or tape used in the prior art for sealing all sides with a homogenous application or sealing the seams are not used in the present invention. The present invention describes and claims a liner and method of application for sealing the seams and lining the panels with a homogenous application of an elastomeric material requiring fewer fasteners used and fewer holes in assembling the panels.

The present invention is directed to a liner for use on the inner surface of a vessel or basin comprising a first coating of zinc applied to the steel panels to galvanize them. A second coating comprises an organic powder coating on the galvanized coating and a third layer of a material such as polyurethane, polyurea, a polyurethane/polyurea blend, or similar. The organic powder is applied electrostatically to provide a uniform and even coating even in blind spots to a clean galvanized steel surface and baked to cure resulting in a sealing coat having good adhesion and providing a bonding surface for the third polyurethane barrier coating layer. The organic powder coating may be an epoxy-like material such as deposited by the Baltibond Corrosion Protection System available from Baltimore Air Coil and described and claimed in the aforementioned U.S. '637 patent. The organic coating is applied to the interior and exterior surfaces in the manufacture of the structure by a multi-step cleaning and drying process to maximize adhesion between the coating and the metal. The coated panels are assembled using threaded fasteners or rivets as is known in the art of mechanical assembly of a large metal vessel or structure. The method of the present invention does not require a separate sealing tape or sealant before application of the third barrier coating layer. The method includes applying the elastomeric material in liquid form over the seams and any portion of the fasteners exposed to the inside of the vessel. In the double break flange assembly of the vessel; all fasteners are typically outside the basin as shown in FIG. 2. In all cases in the present invention, the seams are covered by liquid barrier coating material first to provide a preseal. The method can also further comprise placing of corner forms in the corners and/or at the angled areas where the panels meet or bend to promote drainage and cleaning of the vessel, forming an inner surface with smooth transitions. The barrier coating is sprayed over the entire vessel interior up to and over the maximum standing water level. The barrier coating extends past the junction point for an adjoining panel to provide for the adjoining section to be connected having the seam isolated from the standing water. Often this seam can be further secured by compressing the barrier coating between the flanges or use of a flange ring wherever possible.

The present invention is directed to a liner mechanically coupled to the key areas of the vessel such as sidewalls, high flowage areas and areas of high traffic. The mechanical coupling to the panels is achieved by punching link holes in the panels to allow the powder coating to coat in around and through each hole without closing the opening in the panel. The link holes allow the elastomeric barrier material to flow out of the link hole and form a button-like globule on the outside of the vessel tied to the barrier coating. The elastomeric barrier coating extends from the inside of the vessel to the outside of the panel through the link hole to mechanically attach the barrier coating to the sidewall. The clean dry surface of the organic powder second sealing layer allows the atomized spray of the elastomeric third layer to penetrate the pores and mechanically and chemically attach to the substrate. The organic coating over the galvanized steel provides a second protective layer as well as a bonding layer, and the sealing barrier coating provides a triple level of protection for the metal structure. The barrier coating is an inert material that resists corrosive water conditions and chemicals in the water better than stainless steel, especially in high chloride environments.

The present invention is directed to a process for assembling and sealing a cooling tower, water basin or the like for holding water for cooling, evaporative or condensing systems. The process comprises the steps of forming panels in preconfigured shapes and sizes. The operator punches holes in the panels in a predetermined pattern, the holes spaced from the edges of the panel for further attachment of the barrier coating. The panels are galvanized steel of a type G-235 to provide a first corrosion resistant coating. The number following the G designation refers to the total coating weight on both sides of the sheet in hundredths of an ounce per square foot (oz/ft$^2$) of sheet. Thus, G235 would have a minimum total 02.350 oz/ft$^2$ of coating. The panels comprise a pre-adapted collection of steel panels for assembly into a holding basin. The panels are cleaned by an acid type cleaning solution such as phosphoric acid to remove contaminates followed by a rinse with water to remove the cleaner. The next step is to rinse again to insure the acid solution is removed. Next, the operator dries the panels using air and heat to thoroughly dry the metal and immediately thereafter coat the panels with an organic powder coating such as, for example epoxy, polyester, acrylics or hybrids that are homogenous and designed for application to metals. The powder is applied by electrostatic spray on both sides of the panel especially around the link holes and edges to a typical thickness of 0.004 inches. The coated metal panels are baked usually at around 250-600 degrees for 1 to 20 minutes to thermoset the powder coating 56. The time and temperature are predetermined values depending on the coating and thickness of the steel to cure the coating. The panels are cooled after curing and the clean and coated panels are assembled into subassemblies for application of the barrier coating. The elastomeric barrier coating application steps comprise, first applying in a liquid state, directly over the seams to form a preseal for the seams and prevent the elastomeric material from leaking through the seams during application. Next, the forms, if desired, are placed in the corners and where adjoining panels meet; next spraying the elastomeric material onto the basin including double spraying the seams and any exposed fasteners. The barrier coating coats the interior of the vessel and extends out of the basin and over the basin flange such that the barrier coating extends above the maximum standing liquid level and beyond the attachment to the upper structural section.

The present invention is directed to an elastomeric barrier coating that is double applied over seams and fasteners and extends from in the liquid holding area to outside the liquid holding area by application to the basin and extension along the mounting flange of the basin to a point separated from the inside of the basin by the attachment of the adjacently upper panel attaching to the basin with the liner edge between the respective mounting flanges where possible. Additional attributes of the elastomeric barrier coating include extension of the barrier coating outside the basin, link holes punched in the panels forming a mechanical link to the panel by a button-like knob of barrier coating material formed on the outside of the basin by the liquid elastomeric material flowing out of the link hole and hardening. The link seals the adjacent link hole. The elastomeric barrier coating may be selected from elastomeric coatings and appropriate additives having acid resistance, fast cure times, inert properties, high durability, fire retardancy, and/or ablative properties.

DETAILED DESCRIPTION

Figure 1:
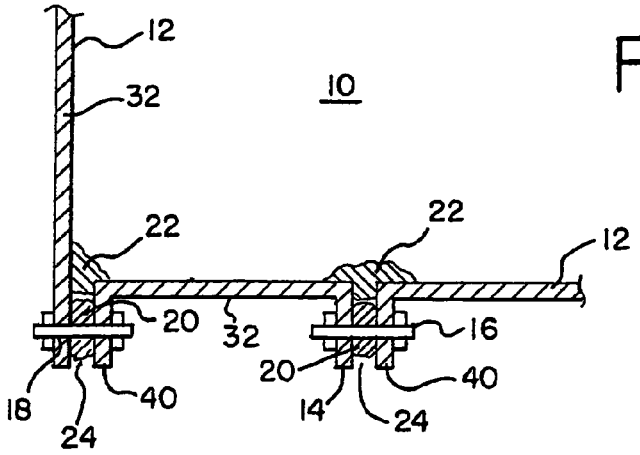
FIG. 1 is a side elevation section view of a prior art seam sealed with tape and caulk over the fasteners and seams.

The prior art basin of FIG. 1 shows a basin 10 made of panels 12 fastened together 215 at the edges 14 of the panel 12. The panels 12 are configured to form a water holding basin 10 having a bottom 30 with an outer edge attached to panels 12 adapted to form a side wall 32. The basin 10 has a bottom 30, a side wall 32. Fasteners 16 extend through the flanges 42 to hold the panels 12 together to form a structure such as a basin 10. The fasteners 16 may be self-tapping sheet metal screws or nut and bolt assemblies depending on individual basin requirements. The number of fasteners 16 is calculated to hold the panels 12 together structurally and for sealing purposes. The fasteners 16 extend through mating fastener holes 18 in adjacent flanges 40 as is well known in the art of assembling panels together into a basin 10 or the like. In the prior art vessels, a sealing tape 20 may be used to seal the seam 24 between panels 12 and a caulk 22 may be used over the seal tape as a secondary 225 sealing measure.

Figure 2:
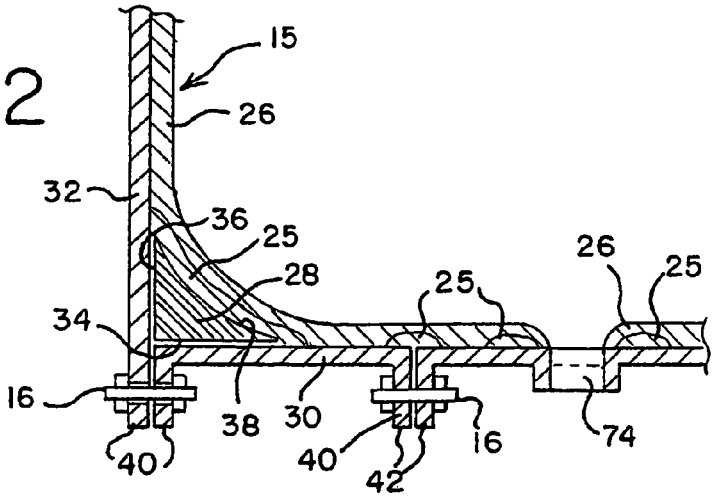
FIG. 2 is a side elevation section view of a basin seam sealed in accordance with the present invention.

Referring to FIG. 2, the panels 12 are joined together at flanges 40 having a fastener portion 42 directed away from the basin 10. The break flanges 40 have the fasteners 16 outside the basin 10 through the flanges 40, also called break flanges 40, to hold the panels 12 together. In accordance with the present invention, the elastomeric barrier coating 26 is 230 applied in liquid form to the seams 24 between the panels 12 to form a pre-seal 25. The elastomeric barrier layer 26 materials flows into the seam 24 between the adjacent panels 12 to fill and seal the seam 24 and form a pre-seal 25 over and in each panel seam 40.

Continuing to refer to FIG. 2, the basin 10 is lined with an elastomeric barrier layer 26 applied in a continuous coat over the fasteners 16 and the seams 24. Corner molds 28 are positioned to smooth the transition at corners such as where the bottom panel 30 meets the lower most side panel 32. These corner molds 28 have a bottom wall 34, a sidewall 36 and an outward wall 38. The bottom wall 34 and sidewall 36 are positioned against adjoining panels 12. The outward wall 38 smoothes the transition between the adjacent panels having a shape that is straight, convex or concave. The corner mold 28 may be a ring shaped, triangular cross-sectioned body for mounting in a circular basin between the sidewalls 32 and the bottom 30. Alternatively, the corner mold 28 may be a plurality of forms having a triangular or other shape to provide a smooth transition between adjoining panels. The corner mold 28 comprising straight sections adapted for mounting in a polygon-sided basin between the sidewalls 32 and the bottom 30 or between the adjoining sidewalls 32. The corner mold 28 can be made of foam, wood, metal, plastic or any material compatible with the elastomeric barrier coating material and substrate. The corner molds are placed in a desired position and sprayed with the third elastomer barrier layer 26 to hold the mold in place as a part of the substrate and intermediate the barrier coating 26 and the basin 10.

Figure 3:
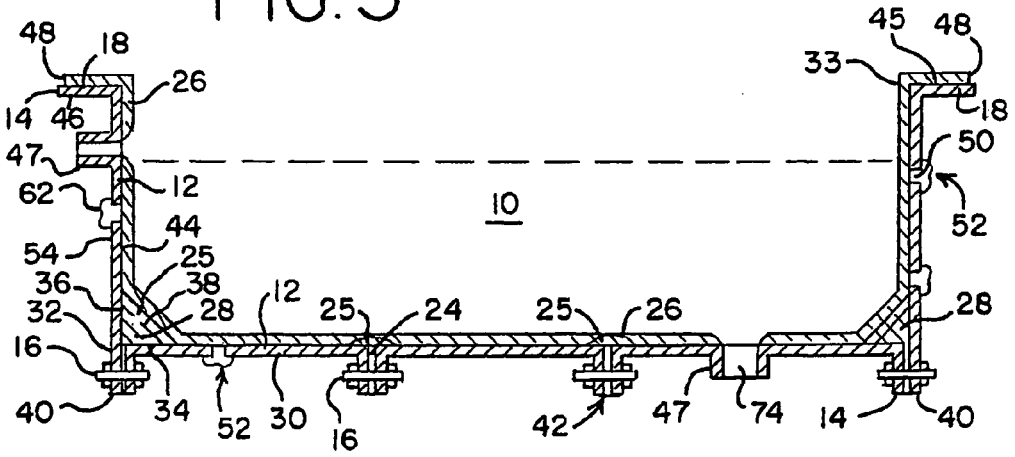
FIG. 3 is a side elevation section view of a pre-sealed and lined basin subassembly in accordance with the present invention.

Referring to FIG. 3, the base 30 and the sidewalls 32 join at approximately a right angle. The side panels 32 and bottom panels 30 are joined at a break flange 40 formed at the edge 14 of each panel. The corner molds 28 are disposed between the adjoining panels and are pre-sealed 25 by an application of barrier coating material. The bottom wall 34 of the corner mold 28 is on the bottom 30 of the basin 10 and the outside wall 38 faces into the basin 10. Inside wall 44 extending along the bottom 30 and sides 32 of the basin 10 defines the water holding area with an open top 33. The corner molds 28 provide a rounded edge for the bottom 30 of the basin 10 reducing the sharp corners and for sloping from the walls 32 to the drain 74. The elastomeric barrier 26 is applied to the inside wall 44, along the top flange 46 into each pipe stub 47 and along the sides 32 and bottom 30. The elastomeric barrier 26 is applied to the basin 10 along the interior wall 44 of the sides 32 and the bottom 30 panels 12. The elastomeric barrier liner 26 is sprayed or otherwise applied over the preferably still warm preseal 25 applied to the seams 24 to form a multilayer homogenous third barrier layer 26. The outside elastomeric barrier 26 is extended up along the sidewalls 32 and onto the mounting surface 45 of the top flange 46 to liner edge 48. Liner edge 48 is disposed outside the interior wall 44 of the basin 10 along the top flange 46 preferably outside the fastener holes 18 on top flange 46. Link holes 50 are punched or drilled through the panels 12 from the inside 44 to the outside 54. It should be understood, the link hole 50 may alternatively be formed as a dent 84 (FIG. 9) or indent on the panel 12. The dent 84 (FIG. 9) creating a contour on the inner surface 44 of 270 the basin 10 to provide a mechanical link between the barrier coating 26 and the panel 12.

Figure 4:
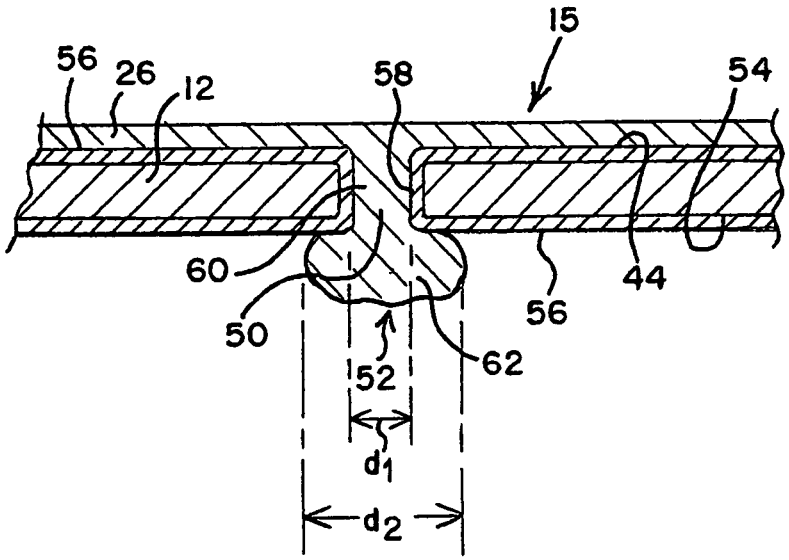
FIG. 4 is a section view of a mechanical link between the barrier coating and the basin panel in accordance with the present invention.

Continuing to refer to FIG. 3, and referring to FIG. 4, the link 52 is formed through the link hole 50 ending in a button head shaped like a knob 62 on the outside 54 of the basin 10. The link hole 50 has a tie diameter d1 and extends from the inside 44 to the outside 54. The link hole 50 is coated with the second layer organic powder 56, along the inner surface 58 of the hole. The barrier layer 26 flows through the link hole 50 on application to the basin 10. The barrier layer 26 forms a tie 60 in the hole 50 and accumulates on the outside 54 of the basin 10 in a knob 62. The knob 62 has a knob diameter d2 that is larger than the link hole 50 to resist being pulled through the link hole 50. The link hole 50 is coated with the second layer organic powder 56, along the inner surface 58 of the hole. The link hole 50 is sealed with the elastomeric barrier coating 26 on the inside 44 and by the knob 62 on the outside 54.

Figure 5:
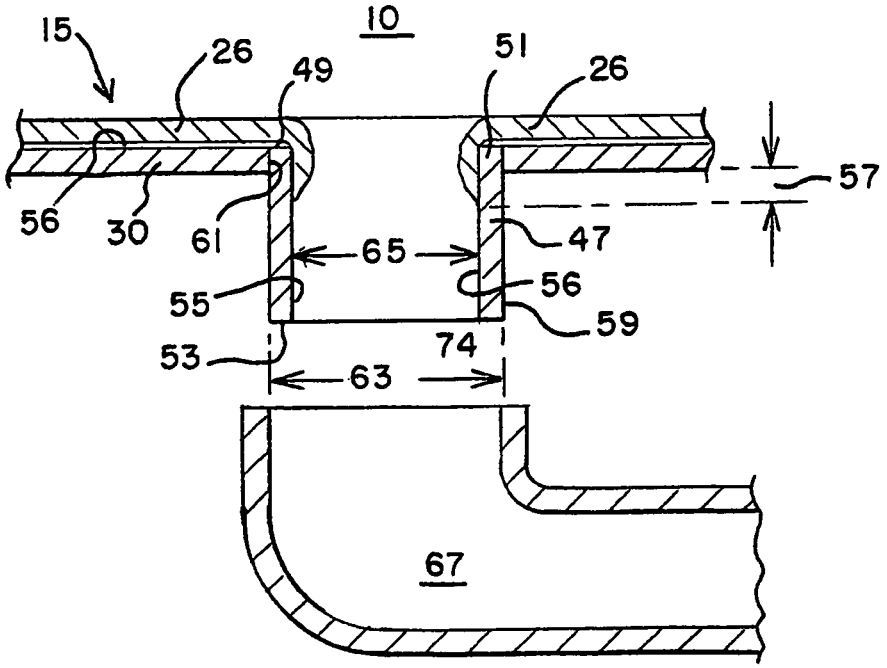
FIG. 5 is a side elevation section view of a connection pipe in the basin in accordance with the present invention.

Referring to FIG. 5, the connector pipe stub 47 is shown as attached to the panel 12. The pipe stub 47 provides an attaching location for source and drain piping 67 at the installation site. The pipe stub 47 is attached to the panel 12 before application of the organic coating 56. The second layer organic powder coating is applied to the panel including around and on the pipe stub 47 to seal the ends, exterior and a portion of the interior of the stub 47 and the weld 49. The pipe stub 47 has an inside end 51 and an outside end 53. The outside diameter 63 and inside diameter 65 of the pipe stub 47 are chosen based on the application, flow rates and customer preference. The pipe stub 47 has an inside wall 55 and an outside wall 59. The pipe hole 61 in the panel 12 is sized slightly larger than the outside diameter 63 to allow the pipe stub 47 to be inserted into the pipe hole 61 to a position having the inside end 51 aligned with the inside surface 44 of the basin 10. The pipe hole 61 in the panel is sized to allow the pipe stub 47 to concentrically fit in the hole 61 for attachment. A weld 49 attaches the pipe stub 47 to the panel 12. The powder coating 56 is electrostatically applied to evenly coat the entire panel pipe stub assembly including the weld 49 and provide a bonding surface for the elastomeric barrier coating 26. The elastomeric barrier 26 is applied to the inside 44 of the panel 12 and extended onto a portion of the inside wall 55 a predetermined distance 57 usually about 2 inches from the inside end 51. The liner edge 48 in the pipe stub 47 is spaced a predetermined distance from the outside end 53 to protect against over heating the barrier coating 26 when the pipe stub 47 is attached to facility piping 67 such as by welding.

Figure 6:
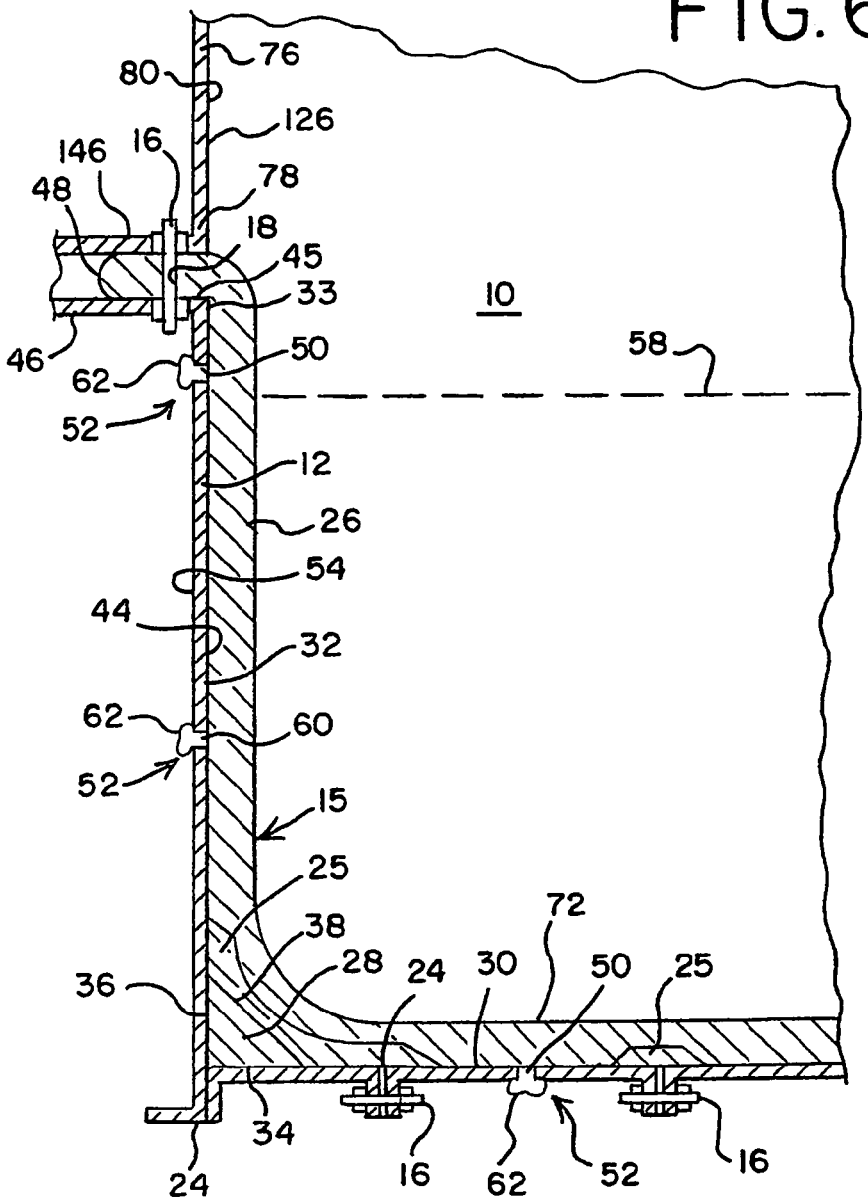
FIG. 6 is a side elevation section view of the mechanical lock on the barrier coating edge between the basin and the upper section in accordance with the present invention.

Referring to FIG. 6, the panels of the sidewall 32 are lined 15 with the first galvanizing layer 70, the second organic powder coating layer 56, and the third elastomeric barrier coating layer 26. The barrier coating 26 extends up to the wall flange 46 and past the fastener 16 and fastener hole 18 to a position spaced from the basin 10 interior. Upper section 64 may be a casing for housing heat transfer coils (not shown) having a sidewall 66 and bottom flange 148 for mateingly attaching to basin sidewall 32. Upper section 64 is attached to basin 10 by aligning the flanges 46, 146 and driving fasteners 16 there through. The fastener 16 may penetrate the barrier coat 26 on the top flange 46. The barrier coating 26 extends intermediate the upper section 64 and the side wall 32. The fastener 16 bears against the flange 46 and flange 68 to compress barrier coating 26 there between. Sealer or a preseal 25 as described above may also be used in this flange joint 24 to help seal the joint. Fastener 16 is intermediate liner edge 46 and the interior of basin 10.

Continuing to refer to FIG. 6, the barrier coating 26 is applied along the interior 44 of the sidewall 32. Link holes 50 are positioned along the panel 12 especially at high action areas such as close to flow interfaces, high traffic areas or where liquid is moving due to a pump or circulating action. The link hole 50 extends through the wall 32, 30 of the panel 12 to allow the elastomeric barrier coating 26 to flow through during application and form a button head 62 on the outside surface 54. The button head 62 is larger than link hole 50 to prevent the button head 62 from being pulled through the hole 50 The button head provides a mechanical link to the panel 12 to promote the connection to the underlying substrate 70 and to hold the barrier coating 26 in place and preserve the integrity of the barrier coating 26 in the basin 10 in the event that the bond between the barrier coating 26 and the powder coating 56 is broken. It should be understood, the outside third layer of an elastomeric material is a barrier coating 26 when properly applied and cured becomes an integral inner surface of the basin 10. The barrier coating 26 having its liner edge 46 is mechanically bound by the attached flanges 46, 146 and is isolated from the basin contents.

Continuing to refer to FIG. 6, the pre-seal 25 over the seams 24 is separately cured and bonded to the barrier coating 26 to become homogenously part of the elastomeric inner barrier coating 26. The pre-seal 25 may also be applied over the corner mold 28. Corner mold 28 is adapted to fit snugly in corner spaces or where two adjoining walls 30, 32 meet. The corner mold 28 has an outer surface 38 adapted to provide a smooth transition between the two adjoining walls 30, 32. The corner mold 28 may have a flat, convex or concave outer surface 38 depending on the angle of intersection of the adjacent walls. The corner mold 28 is placed in the structure before the third layer elastomeric barrier coating 26 is applied to become an integral part of the basin 10. The molds 28 become part of the substrate when covered by the last barrier coating coat 26. The barrier coating 26 on the bottom wall 30 is allowed to gravity cure so the resulting basin bottom 72 is flat or properly sloped to a drain 74 (FIG. 5).

Figure 7:
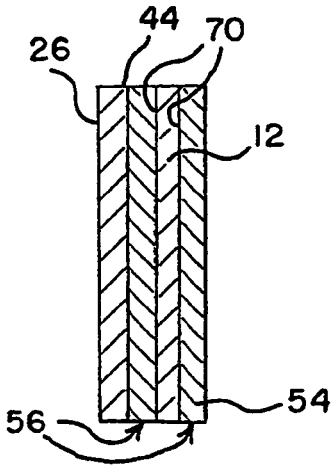
FIG. 7 is a section view of a panel coated and lined in accordance with the present invention.

Referring to FIG. 7, the panel 12 comprises a steel plate 12 having a first layer to resist corrosion of zinc 70 thus galvanizing the steel plate 12. The panels 12 are coated with a thermoset second layer 56 comprising a powdered polymer coating electrostatically applied to both sides 44, 54 and to the inner surfaces of the holes 18, 50 (FIG. 3), 61(FIG. 5). A third barrier layer 26 is applied onto the thermoset layer 56 forming an elastomeric barrier coating 26. The elastomeric barrier coating 26 is formed from a material such as polyurethane, polyurea, a mixture of the two or similar sprayable material on the inside wall 44. The galvanized coating may be of a type well known in the art of coated metals. The organic powder coating 56 protects the inside surface 44 and outside surface 54 of the panel 12 from contaminates and corrosive elements and to provide a clean surface to bond to the elastomeric barrier coating 26. In the preferred embodiment a G235 type galvanizing on the panel works well. The powder coating 56 is an organic type of coating applied to the galvanized steel after it has been cleaned, rinsed and dried preferably using heat. The organic coating 56 is favorably applied using an electrostatic spraying process to evenly coat and hold the powder coating to the galvanized metal 70. A thermoset cure is used to bond the organic coating to the galvanized substrate 12 by baking at a predefined time and temperature predetermined by the requirements of the coating material. The second layer comprising an organic powder coating electrostatically sprayed on the galvanized substrate and baked to cure may be a material such as Coating Powder available from Rohm and Haas Canada, 2 Manse Road, West Hill, Ontario, M1E 3T9, Canada. The Rohm and Haas product is comprised of Calcium metasilicate having a weight percentage between 40 and 50%, an epoxy resin having a weight percentage of between 40 and 50% and titanium dioxide having a weight percentage between 5 and 10%.

Continuing to refer to FIG. 7, the third layer elastomer barrier coating 26 is an elastomeric coating such as a polyurethane, polyurea, or mixture of polyurethane and polyurea or other similar material applied in a liquid form. The barrier coating 26 materials are pumped from separate containers into a two-component spray gun where the components are mixed, atomized and discharged from the gun (not shown). The barrier coating 26 may be a material such as TUFF STUFF or Durabond Polyurethane both available from Rhino Linings, USA, 9151 Rehco Road, San Diego, Calif. 92121. The Rhino Lining TUFF STUFF has two components comprising an A component, isocyanate, part no. 60012 and B component resin, part no. 60021. The barrier coating 26 is applied by liquid form on the seams 24 to pre-seal the joints between panels 12.

Figure 8:
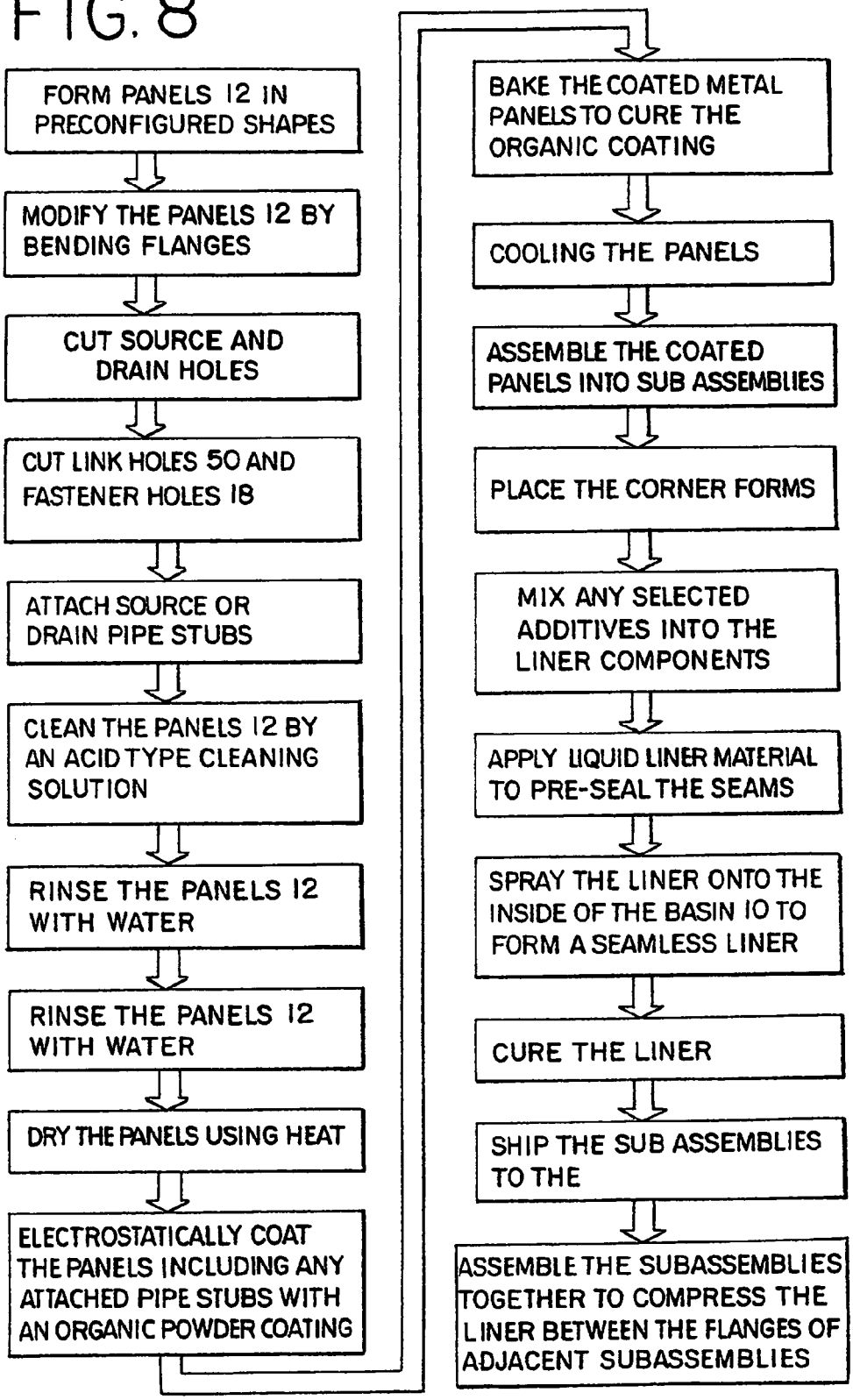
FIG. 8 is a flow chart demonstrating one method of lining a liquid holding basin in accordance with the present invention.

Referring to FIG. 8, the present invention is directed to a process for assembling and sealing a cooling tower, water basin or the like for holding water for cooling, evaporative or condensing processes. The process comprises the steps of:

1. Forming panels 12 in reconfigured shapes and sizes from galvanized steel panels having a type G-235 galvanized coating to provide a first corrosion resistant layer and substrate for subsequent coatings 70.

2. Modifying the panels 12 by bending flanges 46 and punching fastener holes 18 in the flanges for interconnecting the panels 12. The fastener holes 18 formed in a predetermined pattern spaced, from the edges of the panel.

3. Cutting link holes 50 by punching, drilling or other means in the panel 12 to provide mechanical link 52 between the barrier coating 26 and the panel 12.

4. Cutting source and drain holes in the panels at predetermined locations. The holes are sized to receive the outside diameter of the pipe stub therein.

5. Attaching source or drain pipe stubs concentrically into the respective source and drain holes by inserting the pipe stub in the respective hole having the inside end of the stub flush with the inside surface 44 of the basin 10 and welding the stub in place to sealingly attach the stub to the basin 10.

6. Cleaning the panels 12 by an acid type cleaning solution such as phosphoric acid to remove contaminates.

7. Rinsing the panels 12 with water to remove the acid type cleaner.

8. Rinsing the panels a second time to remove as much of the acid solution as possible from the panels 12.

9. Drying the panels using heat to thoroughly dry the metal and immediately thereafter, 10. Coating the panels including the inside and outside surface, including any attached pipe stubs with an organic powder coating such as, for example epoxy, polyester, acrylics or hybrids that are homogenous and designed for application to metals, by electrostatic spray on both sides of the panel especially around the binding holes and edges to a typical thickness of 0.004 inches.

11. Baking the coated metal panels to cure or thermoset the organic coating. The baking process performed in the preferred embodiment at around 250-600 degrees Fahrenheit for 1 to 20 minutes depending on the coating and thickness of the steel.

12. Cooling the panels after curing.

13. Assembling the coated panels into sub assemblies as required for shipping to the installation site.

14. Mixing any selected additives into the barrier coating components for desired mechanical or chemical properties of the barrier coating.

15. Sealing the seams between the panels 12 by application of a liquid state barrier coating material directly over the seams. The liquid barrier coating material preseals the seams and prevents the barrier coating material from leaking through the seams during the barrier coating application 16. Placing the forms, if desired, in the corners, between adjacent panels and where sides meet to provide a smooth transition between adjacent panels.

17. Spraying the elastomer barrier coating onto the inside of the basin 10 to form a seamless barrier coating 26 on the interior of the basin 10, including double spraying the seams and any exposed fasteners and spraying into each pipe stub a predetermined distance and along the vertical walls 32 of the basin and along the mounting flange 46.

18. Curing the barrier coating by time, heat or other method.

19. Shipping the subassemblies to the assembly site for further assembly of the unit structure.

20. Assembling the subassemblies together in a manner that minimizes the exposure of the edge of the barrier coating to water in the basin by capturing the liner 15 between adjacent subassemblies.

Figure 9:
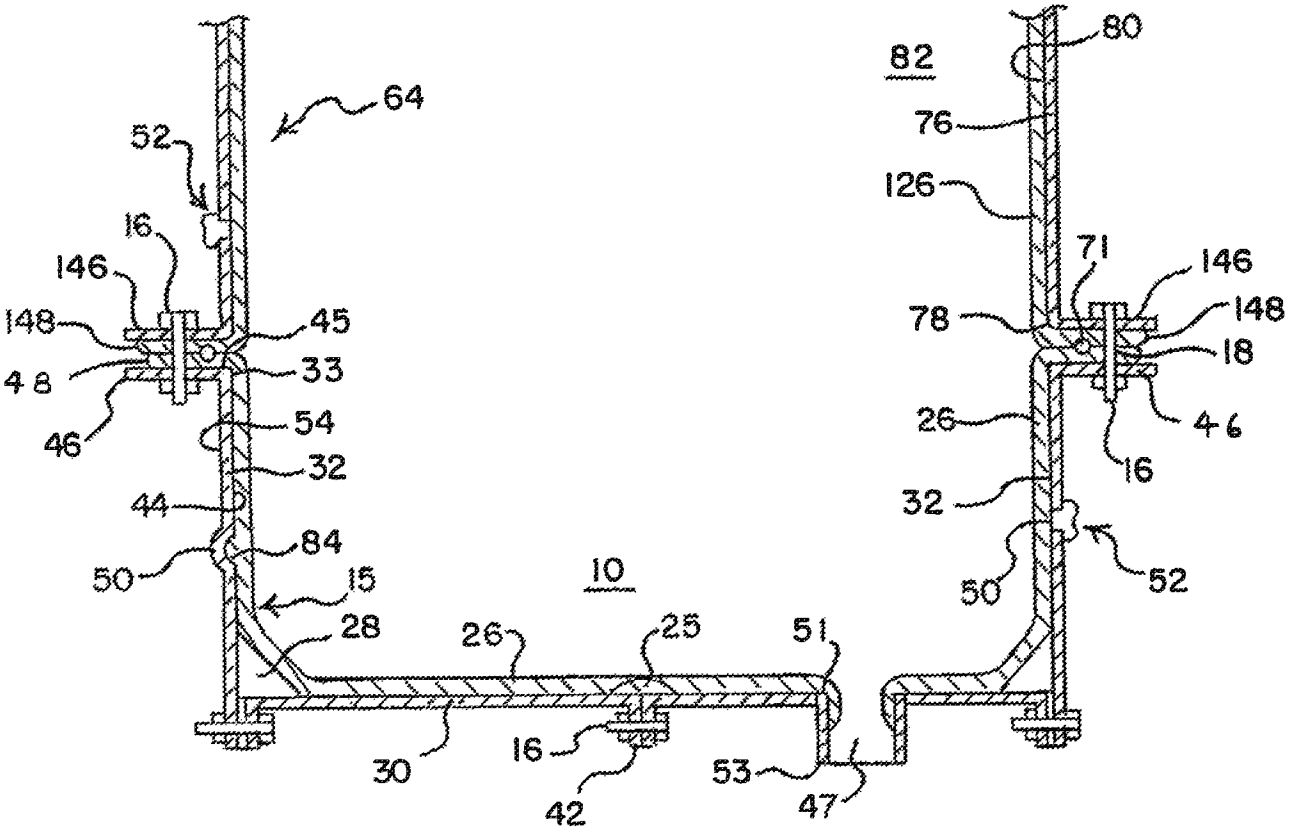
FIG. 9 is a side section view of an assembled structure showing the lined basin and the lined upper section with the respective barrier coating edges captured between the adjoining flanges.

Referring to FIG. 9, an upper section 64 having a sidewall 76 with a bottom 78 and a bottom flange 146 may be pre assembled and mounted to the basin 10 at the customer site. The upper section 64 may be a casing, which mount on the basins and typically have heat transfer coils and/or cooling tower fill therein. The upper section 64 may have an elastomeric upper section barrier 126 on the inside surface 80. The elastomeric barrier 126 may extend outside the interior 82 of the structure 64 along a bottom flange 146. As described above, the basin 10 has a single piece three layer liner 26 along the inside wall 32 of the basin. The liner edges 48 are on the respective mounting flanges 46, 146. Fasteners 16 extend through fastener holes 18 in the top and bottom flanges 46, 146 and through the elastomeric barrier 26 to attach the basin 10 to the upper section 64. The fasteners are preferably intermediate the liner edge 48 and the interior of the basin 10. The edges 48, 148 respective barrier coatings 26 of the upper section 64 and the basin 10 are sealingly compressed along the junction of the mounting flanges 46, 146. In this way, the elastomeric barrier 26 is clamped between the assembled sub assemblies 10, 64 to prevent the barrier coating edge 48 from exposure to the water in the basin 10. It should be understood, the upper section can be lined with the elastomeric barrier 26 or not. In the case that the upper section is not lined, the barrier coating of the basin 10 is captured by the upper section 64 and the basin 10 joined vertically having the liner edge 48 extending out onto the top flange 46 and captured between the mating flanges 46 146. Alternatively, a flange ring 71 or sealer may be used on top of the mounting flange 46 to sealingly isolate the liner edge 48.

In use, the basin is formed from prepared steel panels 12 made of galvanized steel with a zinc coating 70 thereon. The first protective layer is zinc applied during the galvanizing process. The second protective layer 56 is an organic powder electrostatically applied and cured on top of the zinc 70. Applying the organic powder coating 56 provides a clean dry surface and enhance the adhesion of the barrier coating 26 to the basin 10 also seals and protects the galvanized steel panels. The panels 12 are assembled into a basin 10 or other sub structure for holding water or liquid and other subassemblies are also assembled. The third protective layer comprising an elastomer material is sprayed on the basin 10. The elastomer barrier coating 26 material is applied first in liquid form to the seams 24, and joints and areas around the connecting pipes 47 to preseal 25 those areas. The third layer elastomeric barrier coating 26 is then applied by spraying the same or different multi-part elastomer material evenly over the entire inner surface 44 of the basin 10 to form a contiguous coating 26 over the entire interior surface of the basin 10 having the barrier coating 26 extending up to and out of the top of the basin along the mounting flange 46. The barrier coating 26 should preferably be sprayed to a minimum thickness such that the pre-seal layers are covered, and the liner 15 is a uniform thickness forming a smooth interior surface across the entire basin. The third elastomeric layer 26 is applied to a minimum is 1/16" up to a preferred maximum of 1/8". The third layer barrier coating 26 can be thicker to 1" if the environment and liquid conditions require this thickness of protection. The barrier coating 26 is preferably extended above the maximum standing water level in the basin 10 to isolate the liner edge 48 from the water.

After preparing the panels 12 by cutting, punching, bending and welding, the organic powder coating 56 is applied to both sides of each panel, on the inside surface of the link holes 50 and over and inside the pipe stubs 47 and their welded connection to the panel 12. The organic coating 56 provides a fresh surface where the elastomeric barrier coating 26 adheres to the organic coating 56 better than adhering to the galvanized 70 (FIG. 7) surface to secure the barrier coating 26 in place in the basin 10. The galvanized layer 70 (FIG. 7) and the organic coating 56 provide a two coat bonding layer for the third coat elastomer barrier coating 26. The zinc of the galvanizing 70 (FIG. 7) adheres very well to the underlying steel panel 12, the organic powder coating 56 is tightly bonded to the zinc coating 70 (FIG. 7) and the elastomer barrier coating 26 tightly bonds to the organic coating 56. The organic powder coating 56 may be a coating like Baltibond® available from Baltimore Air Coil. Other organic powder coatings include powder coating such as, for example, epoxy, polyester, acrylics or hybrids that are homogenous and designed for application to metals. An organic coating 56 having a microscopically porous outer surface provides a mechanically bonding site for the barrier coating material along with a chemical bonding mechanism. The barrier coating is applied in liquid form from the mixing gun (not shown) where the components are mixed, atomized allowing the liquid barrier coating to flow into the pores of the organic coating and mechanically and chemically bond the barrier coating 26 to the organic coating 56.

The elastomer barrier coating 26 is preferably a two part polyurethane mixture. The multiple parts are mixed during the application process. In the present invention a spray gun is provided having inputs for each of the individual barrier coating components wherein the parts are mixed at a predetermined ratio while being atomized and propelled out of the gun at the nozzle to be applied to the surface of the vessel 10. The elastomeric barrier coating 26 materials may also be polyurea or a mixture of polyurea and polyurethane. It should also be understood the barrier coating material may have additives to adjust the cure time, improve UV resistance, change impact, slip and chemical resistance, add color to the barrier coating, and improve fire retardancy, and increase durability and traction among other attributes. Additional chemicals or accelerants can be mixed with the barrier coating mixture to accelerate cure time. In the preferred environment the partial cure time or setup time is calculated to be less than one minute to allow ongoing work on the vessel 10 shortly after application of the elastomer barrier coating 26, to reduce uneven application due to dripping, and allow multiple spray layers as in the pre-sealing of the seams of the basin. Additives with solvent properties to the organic bonding layer 56 may be added to the elastomer barrier coating 12 materials to provide an additional chemical bonding to the organic powder coating. Upon application the elastomer barrier coating material 12 would soften the outside surface of the organic coating causing a chemical mixture with the liquid barrier coating material. Upon curing the two layers, organic coating and barrier coating would be chemically bonded as well.

The elastomer third layer barrier coating 26 is applied to the inside wall 44 from the top flange 46 into each pipe stub 47 and along the sides 32 and bottom 30 and over the top flange 46 on the other side. The elastomer barrier coating 26 is applied to the basin 10 along the interior wall 44 of the sides 32 and the bottom 30 panels 12. The barrier coating 26 flows over the first coat preseal 25, applied to the seams 24 and fasteners 16, to form a multilayer homogenous barrier coating 26 sealing the seams 24 and protecting the substrate. The elastomer barrier coating 26 is preferably applied before the pre-seal 25 is fully set up to allow the maximum bonding between the barrier coating layer 26 and the preseal 25. The barrier coating 26 should preferably be sprayed to a thickness such that the pre-seal layers are covered, and the liner is a uniform thickness across the entire basin. The elastomer barrier coating is extended up along the sidewalls 32 and over mounting wall flange 46 to a point outside the basin where possible. The liner edge 48 is captured and compressed between the top flange 46 of the basin sub assembly and the bottom flange 148 of the mating panel to prevent any chance of water attacking the edge bond to the panel 12. Liner edge 48 is disposed outside the interior wall 44 of the basin 10 along the wall flange 46 between the fastener holes 18 and the panel edge 14 but may extend out to the edge of the flange 46. Link holes 50 are formed to extend through the panels 12 from the inside 44 to the outside 54. During application, the elastomer barrier coating 26 material flows out through the link holes 50 and forms a retaining knob 62 adjacent the exterior wall 54 of the basin 10 creating a mechanical button like link between the outer layer 54 and the inner layer 44 wherein the button 62 cannot pull through the link hole 50 and thereby holds the barrier coating to the panel 12, filling the hole and forming a mechanical link to the panel and the elastomer barrier coating 26, while simultaneously increasing the bonding surface area for greater adhesion compared to a flat surface only. The tie 60 and the knob 62 are formed of the elastomeric material of the barrier layer 26 which flows through the link hole 50 upon application of the barrier coating 26.

The vessel is filled with water usually treated with chemicals to control water chemistry and to prevent biological growth and circulated in the system for cooling or heat transfer, etc. The barrier coating protects the metal structure and seals the seams and link holes to contain the water and protect the steel panels. The seams 25 and link holes 50 provide a tattletale status of a leak or water seeping behind the barrier coating and next to the panel 12. If a rip or fault in the barrier coating 26 allows water between the barrier coating and the basin substrate, the water will seep out of the seam or link hole to indicate a problem with the barrier coating. This early indicator may allow repair of the barrier coating before corrosive damage happens to the underlying structural panel.

Although the invention has been described above in connection with particular embodiments and examples, it will be appreciated by those skilled in the art that the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

We claim:

1. A method of applying a multi-layer liner on a basin and an upper section, the basin comprising a plurality of interconnected steel panels, the panels connected together forming a bottom and sidewalls of the basin, the sidewalls having an inside and an outside, the inside of the sidewalls and the bottom defining an interior of the basin and the outside of the sidewalls defining an exterior of the basin, a plurality of seams between the panels, the method comprising:

providing the steel panels with a first galvanizing layer;

applying a thermoset layer of an organic coating on the first galvanizing layer, the organic coating comprising a powder coating elastomerically applied to the surface of each of the plurality of plates;

applying a preseal on the seams, the preseal comprising an elastomer liner material applied in liquid form to the seams;

applying a barrier coating mechanically linked to the basin, the barrier coating on the interior of the basin, the barrier coating comprising a sprayed on elastomer material, the elastomer material bonding to the organic coating along the interior portion of the basin, wherein the galvanizing layer attaches to the steel panels, the organic coating bonds to the galvanizing layer and the barrier coating bonds to the organic coating and the preseal to form a three layer water tight corrosion resistant liner on the interior of the basin, and an upper section, the basin further comprising a top flange on the top of the basin, the upper section comprising side walls having a bottom, a bottom flange on the bottom, the barrier coating on the top flange, the barrier coating having a liner edge, the liner edge between the top flange and the bottom flange, applying a powder coating on the upper section, an elastomeric liner on the powder coating on the upper section, the elastomer liner on the inner surface of the upper section and the bottom flange whereby the elastomeric liner and the barrier coating on the basin are clamped between the top flange and the bottom flange, and a plurality of fastener holes on the top flange intermediate the liner edge and the side wall and on the exterior of the basin, the bottom flange further comprising a plurality of fastener holes matingly aligned to the fastener holes in the bottom flange, a fastener in one of the plurality of fastener holes in the top flange and extending through an aligned fastener hole in the bottom flange, the fastener penetrating through the barrier coating on the top flange.

* * * * *